US005236607A

United States Patent [19]

Harris et al.

[11] Patent Number: 5,236,607

[45] Date of Patent: Aug. 17, 1993

[54] PREPARATION OF LITHIUM SOAP THICKENED GREASES

[75] Inventors: John W. Harris, Houston, Tex.; Robert S. Hall, Burlington, Canada

[73] Assignee: Shell Oil Company, Houston, Tex.

[21] Appl. No.: 794,107

[22] Filed: Nov. 18, 1991

[30] Foreign Application Priority Data

Jan. 15, 1991 [GB] United Kingdom ..... 9100800

[51] Int. Cl.[5] ..... C10M 117/02

[52] U.S. Cl. ..... 252/41; 252/18; 252/40

[58] Field of Search ..... 252/41, 40, 18

[56] References Cited

U.S. PATENT DOCUMENTS

| | | | |
|---|---|---|---|
| 2,695,878 | 11/1954 | Entwistle | 252/41 |
| 2,697,693 | 12/1954 | Browning et al. | 252/41 |
| 2,898,298 | 8/1959 | Zweifel et al. | 252/41 |
| 3,042,615 | 7/1962 | Franklin | 252/41 |
| 3,244,628 | 4/1966 | Hencke | 252/41 |
| 3,790,479 | 2/1974 | Hommer | 252/41 |
| 3,891,564 | 6/1975 | Carley | 252/40 |
| 4,435,299 | 3/1984 | Carley | 252/41 |
| 5,015,403 | 5/1991 | Eisenstein | 252/40 |

*Primary Examiner*—Jacqueline V. Howard

[57] ABSTRACT

The invention provides a process for the preparation of a lithium soap thickened grease which consists of heating a mixture of an oil and a lithium base, and optionally also a calcium base, to at least 100° C., then adding a $C_{10-24}$ saturated or unsaturated fatty acid, and heating the resulting mixture at a temperature in the range 110° C. to 200° C. until a thickened grease is obtained.

11 Claims, No Drawings

PREPARATION OF LITHIUM SOAP THICKENED GREASES

BACKGROUND OF THE INVENTION

1. Field of the Invention

This invention relates to the preparation of lithium soap thickened greases, including mixed lithium-calcium soap thickened greases.

2. Description of the Related Art

Lithium soap thickened greases have been known for many years. Typically, the lithium soaps are derived from $C_{10-24}$, preferably $C_{15-18}$, saturated or unsaturated fatty acids or derivatives thereof. One particular derivative is hydrogenated castor oil, which is the glyceride of 12-hydroxystearic acid. 12-Hydroxystearic acid is a particularly preferred fatty acid.

Conventional processes for preparing lithium 12-hydroxystearate thickened greases have typically involved a step of heating an oil based reaction mass to above 200° C. in order to melt the lithium 12-hydroxystearate. Temperatures above 200° C. are not readily accessible with low pressure steam heating. Low pressure steam heating is a very convenient and widely used form of heating employed by grease makers.

U.S. Pat. No. 2,695,878 relates to lithium greases based on lithium soaps of 12-hydroxystearic acid. It describes the problem of conventional processes which require heating of reaction masses containing lithium soaps of 12-hydroxystearic acid, usually including most of the oil, to about 425° F. (218° C.), at which temperature the mass is fluid. Unless this high temperature is attained, the consistency of the grease is low so that excessive proportions of soap are required for a given penetration grease and the appearance and texture of the grease are poor. The solution to this problem propounded by U.S. Pat. No. 2,695,878 involves heating 12-hydroxystearic acid, either alone or in the presence of a trace of mineral acid. to about 150° to 300° F. (66° to 149° C), and holding at this temperature for a few hours to obtain polymerised 12-hydroxy- stearic acid. Lithium base, e.g. lithium hydroxide monohydrate, is mixed with the polymerised acid, preferably in the presence of oil, and the heated mixture is agitated until substantially all of the water has been removed (around 220° to 250° F.) (104° to 121° C). Heating is then continued in the presence of oil until the temperature of the soap-oil mixture has reached 300° to 330° F. (149° to 166° C.).

U.S. Pat. No. 2,697,693 relates to the manufacture of lithium soap greases and lists various disadvantages of the conventional process which is stated to involve heating a mixture of lithium 12-hydroxystearate and oil to above about 400° F. (204° C.), e.g. 425° F. (218° C.). These disadvantages all relate to the use of such high temperatures. U.S. Pat. No. 2,697,693 avoids these temperatures by subjecting a mixture comprising lubricant base (oil). lithium hydroxy soap constituents (e.g. lithium hydroxide hydrate, and 12-hydroxystearic acid or hydrogenated castor oil) and at least about 1 percent of water to a temperature of at least about 275° F. (135° C.), preferably from about 300° F. (149° C.) to about 330° F. (166° C.), and super-atmospheric atmospheric pressure, agitating the mixture, relieving the pressure after the mixture has reached that temperature by venting the steam therefrom, and maintaining the mixture at substantially that temperature while venting the steam.

The resulting grease may advantageously be smoothed by milling, e.g. in a colloid mill.

U.S. Pat. No. 2,898,298 also mentions the disadvantage of the prior art processes requiring temperatures of about 400° F. (204° C.) to 425° F. (218° C.), and provides a lithium soap grease based on the lithium soap of a glyceride of a soap-forming hydroxy fatty acid such as the glyceride of 12-hydroxystearic acid, e.g. hydrogenated castor oil, optionally containing 10 to 20% of a lithium soap of a conventional grease-making fat, fatty acid or other soap-forming organic acid. The grease is made at a maximum temperature of about 330° F. (166° C.), e.g. by agitating a mixture of oil, fat and lithium hydroxide. oxide or carbonate at about 180° to 220° F. (82° to 105° C.) for 20 to 30 minutes to effect saponification,followed by dehydrating by raising the temperature to above 260° F. (127° C.), preferably to about 300° to 330° F. (149° to 166° C.). The resulting unhomogenised grease is then finished by milling in a colloid mill to provide gel strength in terms of ASTM penetration for the homogenised grease equivalent to about 25 to 125 penetration points increase in hardness relative to that of the unhomogenised grease.

U.S. Pat. No. 3,891,564 relates to the preparation of mixed lithium-calcium soap thickened greases, and provides a non-melt process wherein a mixture of lithium hydroxide or oxide e.g. lithium hydroxide monohydrate), water, oil base, saponifiable material (e.g. 12-hydroxystearic acid, stearic acid, hydrogenated castor oil, myristic acid, preferably 12-hydroxystearic acid) and calcium hydroxide or oxide (e.g. hydrated lime) are heated together up to but not exceeding the melting point of the calcium soap. The temperature must thus be kept below 293° F. (145° C.)), preferably at a temperature from 230° to 293° F. (100° to 145° C.).

U.S. Pat. No. 2,697,693 defines the "yield" of a grease making process as "the relationship between the amount of soap employed and the amount of oleaginous vehicle employed to produce a given quantity of grease of desired properties. Thus, the smaller the amount of soap employed to obtain a given quantity of grease of a particular consistency, the higher is said to be the "yield"." One appropriate test of consistency is the grease penetration test, ASTM D217.

There has now surprisingly been found a straightforward process for preparing lithium soap thickened greases at temperatures accessible by low pressure steam heating, which enables good yield to be achieved.

SUMMARY OF THE INVENTION

According to the present invention there is provided a process for the preparation of a lithium soap thickened grease which comprises heating a mixture of an oil and a lithium base, and optionally also a calcium base, to at least 100° C., e.g. 110° to 170° C., thereafter adding a $C_{10-24}$ saturated or unsaturated fatty acid or a derivative thereof, and heating the resulting mixture at a temperature in the range 110° C. to 200° C. until a thickened grease is obtained.

DESCRIPTION OF THE PREFERRED EMBODIMENTS

The lubricating oil can be a mineral oil or a synthetic lubricating oil, such as an ester oil, a silicone oil or a polyphenyl ether. The amount of oil is usually at least 50, and preferably 60 to 80, % by weight of the final composition of the grease.

The lithium soap content, or, where calcium is also present, lithium and calcium soap content may typically be in the range 3 to 15% w, although the content may be in the range 15 to 30% w if desired.

Various other additives can be incorporated into greases prepared by the process of this invention. For example, any or all of extreme-pressure additives, anti-corrosion additives and anti-oxidants may be included, at any suitable stage of the process.

Suitable extreme pressure additives include lead naphthenate, other organic metal salts, sulphurised fatty oils and derivatives and other sulphurised organic compounds. Suitable anti-corrosion additives include nitrites, such as sodium nitrite, organic metal salts and suphurised fatty oils. Suitable anti-oxidants include phenothiazines, such as N-benzylphenothiazine, phenolic compounds, aromatic amines, organic metal salts and sulphurised fatty oils.

The proportions of each of such additives can be in the range 0.1 to 20% by weight, based on the final composition, although the total amount of additives, plus lithium soap, or lithium and calcium soaps, will generally constitute a minor proportion (i.e. less than 50% w) of the total composition.

When calcium is also present in the process of the invention, the calcium is preferably present in an amount up to 50% of the chemically equivalent amount of the lithium. (2 mol lithium hydroxide is equivalent to 1 mol calcium hydroxide).

The process of the invention may very conveniently be effected in a grease kettle equipped with a recirculation line to allow good recirculation of kettle contents from the bottom of the kettle to its top.

Grease "yield" may suitably be enhanced in a preferred process of the invention wherein the resulting thickened grease is sheared in a mill or a homogeniser, optionally with addition of additional oil. An example of a suitable homogeniser is a Mantin Gaulin homogeniser.

The lithium base may be, for example, lithium hydroxide, lithium oxide or lithium carbonate. Advantageously the lithium base is lithium hydroxide monohydrate.

The calcium base, when present, may be, for example, calcium oxide or calcium hydroxide. Advantageously the calcium base is hydrated lime.

The fatty acids or derivatives may conveniently be acids per se, or $C_{1-\alpha}$ esters, or glycerides thereof. Suitable such acids are listed in Page 502, Vol. 14., Kirk-Othmer, "Encyclopedia of Chemical Technology", 3rd Ed., John Wiley and Sons Inc., USA (1981), e.g. oleic, palmitic, stearic and other carboxylic acids derived from tallow, hydrogenated fish oil, castor oil, wool grease and rosin. Hydrogenated castor oil is the glyceride of 12-hydroxystearic acid. The most preferred fatty acid is 12-hydroxystearic acid.

In a preferred process of the invention, the fatty acid is added to the mixture of oil and base at a temperature in the range 110° to 170° C., more preferably 140° to 150° C.

It is further preferred for the resulting mixture to be heated at a temperature in the range 140° to 166° C., more preferably 140 to 150° C. until the thickened grease is obtained.

The invention further includes lithium soap thickened greases, including lithium-calcium soap thickened greases whenever prepared by a process in accordance with the invention.

The ranges and limitations provided in the instant specification and claims are those which are believed to particularly point out and distinctly claim the instant invention. It is, however, understood that other ranges and limitations that perform substantially the same function in substantially the same way to obtain substantially the same result are intended to be within the scope of the instant invention as defined by the instant specification and claims.

EXAMPLES

The invention will be described by the following example(s) which are provided for illustrative purposes and are not to be construed as limiting the invention:

EXAMPLE 1

Preparation of Mixed-Base Lithium-Calcium 12-Hydroxystearate Grease

A grease kettle equipped with stirring, heating and an external recirculation system, capable of pumping the contents from the bottom of the kettle to the top, was charged with 4428.6 grams of high viscosity index (HVI) mineral oil of viscosity 110 $mm^2/s$ (cSt) at 40° C., 50.0 grams of lithium hydroxide monohydrate and 21.4 grams of hydrated lime. The mixture was stirred and heated to 100° C. while the heating rate was maintained to control foaming. After foaming stopped, recirculation was started and the mixture was stirred and heated at 140° C. Over a 10 to 15 minute period, 500 grams of 12-hydroxystearic acid was added slowly to control foaming. After the neutralization step was complete, the charge was heated to 150° C. with stirring and recirculation. The charge was held at this temperature for approximately one hour until the product began to thicken. The heat was then shut off and the charge allowed to cool to below 100° C. while stirring and recirculation were maintained. A portion of the resulting grease. having a soap thickener content of about 1O% w, was then passed through a Mantin Gaulin homogenizer at a pressure of 41000 kPa. The resulting smooth grease was designated Grease I-A.

A portion of unmilled grease was diluted, with HVI mineral oil of viscosity 110 $mm^2/s$ at 40° C, to a soap thickener content of 8.37% w and passed through a Mantin Gaulin homogenizer at a pressure of 41000 kPa. The resulting smooth grease was designated Grease I-b.

COMPARATIVE EXAMPLE

Preparation of Mixed-Base Grease Without Preheating of Base

A grease kettle, as described in Example 1 was charged with 4428.6 grams of HVI mineral oil of viscosity 110$mm^2/s$ (cSt) at 40° C., 50.0 grams of lithium hydroxide monohydrate, 21.4 grams of hydrated lime and 500.0 grams of 12-hydroxystearic acid. Once the fatty acid melted at about 80° C., recirculation was started. Heating was then continued to 100° C., with rate of heating slow enough to control foaming. After foaming stopped, the mixture was heated to 150° C. while stirring and recirculation were maintained. The charge was held at this temperature for approximately one hour until the product began to thicken. The heat was then shut off and the charge allowed to cool to below 100° C., while stirring and recirculation were maintained. The grease, having a soap thickener content of about 1O% w, was then passed through a Mantin Gaulin homogenizer at a pressure of 41000 kPa. The resulting grease, which had a grainier texture than the greases of Example 1, was designated Grease Comp. A.

EXAMPLE 2

Preparation of Lithium 12-Hydroxystearate Grease

A grease was manufactured according to the method described in Example 1 except that 70.4 grams of lithium hydroxide monohydrate were used in place of the combination of 50 grams of lithium hydroxide monohydrate and 21.4 grams of hydrated lime. The grease, having a soap thickener content of about 1O% w, was passed through a Mantin Gaulin homogenizer at a pressure of 41000 kPa and the resulting smooth grease was designated as Grease II.

COMPARATIVE EXAMPLE B

A grease was manufactured according to the method described in Comparative Example A, except that 70.4 grams of lithium hydroxide monohydrate were used in place of the combination of 50 grams of lithium hydroxide monohydrate and 21.4 grams of hydrated lime. The grease, having a soap thickener content of about 10 percent, was passed through a Mantin Gaulin homogenizer at a pressure of 41000 kPa and the resulting grease was designated as Grease Comp. B.

The greases of Comparative Examples A and B are prepared by methods corresponding generally to the disclosure of U.S. Pat. No. 3,891,564.

The "yield" of a grease making process is assessed by the amount of thickener required to provide a given grease consistency, as measured by the grease penetration test (ASTM D-217).

Various properties, viz. worked penetration (ASTM D-217), dropping point (ASTM D-2265) and pressure bleed (ASTM D-1742), were assessed for the greases of the Examples. Results are given in Table I following:

TABLE 1

| | GREASE PROPERTIES | | | | |
|---|---|---|---|---|---|
| | GREASE SAMPLE | | | | |
| PROPERTY | I-A | I-B | COMP. A | GREASE II | COMP. B |
| SOAP THICKENER CONTENT % BY WT. | 10 | 8.37 | 10 | 10 | 10 |
| WORKED PENETRATION ASTM D-217 (60 strokes) (dm) | 234 | 285 | 280 | 267 | 387 |
| DROPPING POINT ASTM D-2265 (°C.) | 187.3 | 190.7 | 182.0 | 198 | 208.9 |
| PRESSURE BLEED ASTM D-1742 (% BY WT) | 0.39 | 2.87 | 3.7 | 1.9 | 12.0 |

On the basis of the grease penetrations listed in Table I, Grease I-A is significantly harder than Grease Comp. A, as indicated by the smaller grease penetration number, even though both greases have the same soap thickener content. This shows that the method of Example 1 provides a better yield. The better yield from Example 1 is also illustrated by the fact that Grease I-B has a similar grease penetration to Grease Comp. A even though Grease I-B has a significantly lower soap thickener content.

The advantage of the current invention is more pronounced in the case of lithium greases. Lithium grease was prepared with preheating of the lithium hydroxide monohydrate (Example 2, Grease II) and without preheating of the lithium hydroxide (Comparative Example B, Grease Comp. B). As indicated by the grease penetrations listed in Table 1, Grease II was obtained with much better yield, based on thickener content, than Grease Comp. B.

What is claimed is:

1. A process for the preparation of a lithium soap thickened grease which consists essentially of heating a mixture of an oil and a lithium base to a temperature from about 110° C. to about 170° C., adding a $C_{10-24}$ saturated or unsaturated fatty acid or $C_{1-4}$ esters or glycerides thereof, and heating the resulting mixture at a temperature in the range from about 140° C. to about 150° C. until a thickened grease is obtained.

2. The process according to claim 1 wherein the mixture further comprises a calcium base.

3. A process according to claim 1 further comprising shearing the thickened grease in a mill or a homogeniser.

4. The process according to claim 3 wherein an additional oil is added to the thickened grease before or during shearing.

5. The process according to claim 1 wherein the lithium base is lithium hydroxide monohydrate.

6. The process according to claim 2 wherein the calcium base is hydrated lime.

7. The process according to claim 1 wherein the fatty acid is 12-hydroxystearic acid.

8. The process according to claim 1 wherein the fatty acid is added to the mixture of oil and base at a temperature in the range 110° to 170° C.

9. The process according to claim 8 wherein the fatty acid is added to the mixture of oil and base at a temperature in the range 140° to 150° C.

10. A lithium soap thickened grease composition prepared by a process according to claim 1.

11. A process for the preparation of a lithium soap thickened grease which comprises heating a mixture of an oil and lithium hydroxide monohydrate to at least 100° C., adding 12-hydroxystearic acid and heating the resulting mixture at a temperature between 140° to 166° C. until a thickened grease is obtained.

* * * * *